US005178385A

United States Patent [19]

Barbador

[11] Patent Number: 5,178,385

[45] Date of Patent: Jan. 12, 1993

[54] PORTABLE GAME APPARATUS

[76] Inventor: David L. Barbador, 11 Simcoe Street, Collingwood, Ontario, Canada, L9Y 1H5

[21] Appl. No.: 793,571

[22] Filed: Nov. 18, 1991

[51] Int. Cl.[5] ..... A63B 67/04
[52] U.S. Cl. ..... 273/30
[58] Field of Search ..... 273/30

[56] References Cited

U.S. PATENT DOCUMENTS

| | | | |
|---|---|---|---|
| 1,553,682 | 9/1925 | Froud et al. | 273/30 |
| 2,127,873 | 8/1938 | LeGuillou | 273/30 |
| 2,313,701 | 3/1943 | White | 273/30 |
| 2,447,743 | 8/1948 | Dieter | 273/30 |
| 3,858,877 | 1/1975 | Lundstrum | 273/30 |
| 4,037,838 | 7/1977 | McCune | 273/30 |
| 4,176,842 | 12/1979 | Zaldivar | 273/30 |

FOREIGN PATENT DOCUMENTS

| | | | |
|---|---|---|---|
| 1478055 | 5/1969 | Fed. Rep. of Germany | 273/30 |
| 203516 | 9/1932 | United Kingdom | 273/30 |

*Primary Examiner*—Theatrice Brown
*Attorney, Agent, or Firm*—Nies, Kurz, Bergert & Tamburro

[57] ABSTRACT

A novel table type tennis game apparatus comprising a base section which is formed by a center plate and two end plates assembled and held together by vertical walls from which a ping pong ball might ricochet during playing. Each of the flat plates forming the base section is foam molded from a thermoplastic material and includes a reinforcing lattice type rib construction and integrally molded slots which cooperate with tabs on the side walls to hold the game apparatus together. A net connects to and extends between the side walls and includes an elastic portion by which tension is applied to the net and the side walls.

8 Claims, 5 Drawing Sheets

PORTABLE GAME APPARATUS

BACKGROUND OF THE INVENTION

This invention relates generally to a table tennis game apparatus of the type disclosed in my earlier U.S. Pat. No. 4,969,645. More particularly this invention relates to a novel game apparatus which is an improvement over the construction illustrated in my earlier patent, the disclosure of which is incorporated herein by reference.

The game apparatus illustrated in my earlier patent comprised a base section formed by a pair of flat, transparent, plexiglass sheets brought together to form a flat, horizontal playing surface approximately 3 feet by 6 feet in size. A pair of laterally-spaced longitudinally extending channels or slots are formed on top of each of the sheets by separate spaced strips. When the sheets are brought together the slots on each of those sheets are in longitudinal alignment. A pair of vertical side walls constructed of plexiglass approximately 18 inches high by 48 inches long fit within the aligned slots with the side walls thereby being supported in the upright position and locking the flat sheets together. A standard type net five inches high extends laterally between the vertical walls and is fixed thereto by cooperating Velcro type connectors. The game is played in the usual fashion using the standard paddles and ping pong ball, with variations permitted by the wide walls as described in my earlier patent.

While this particular construction advantageously provided a portable game apparatus which was convenient to handle and store and easy to assemble and disassemble, I found that this design was not totally satisfactory from production and cost standpoints, and I have now improved my earlier design to facilitate commercialization of my invention.

SUMMARY OF THE INVENTION

Accordingly, it is a primary object of this invention to provide a novel table type game apparatus, which not only is portable, convenient to handle and store, easy to assemble and disassemble, and playable on any flat support surface as was my earlier design, but is also cheaper to manufacture, lighter in weight, and requires less space for packaging and storage in its knockdown condition.

Another object of the invention is to provide the above novel, improved table type tennis game apparatus wherein the horizontal playing surface is comprised of at least three flat sheets or plates molded, e.g., from lightweight low-pressure structural foam material, having slots molded in place to snugly receive downwardly depending tabs formed integrally on the vertical plexiglass side walls.

Still another object of the invention resides in the provision of the above novel, improved game apparatus wherein each of the foam-molded sheets is formed with a lattice-type rib assembly which provides strength and stability to the sheets without substantially adding to its lightweight characteristics.

Still another object of the invention resides in the provision of the above novel game apparatus wherein the flat sheets comprise a center sheet and opposite end sheets, all of which are substantially identical in construction except for the slots so as to facilitate production thereof from a common mold assembly.

These and other objects of the invention will become apparent from reading the following detailed description of the drawings wherein like numerals indicate like elements.

DETAILED DESCRIPTION OF THE INVENTION

Figure 1:
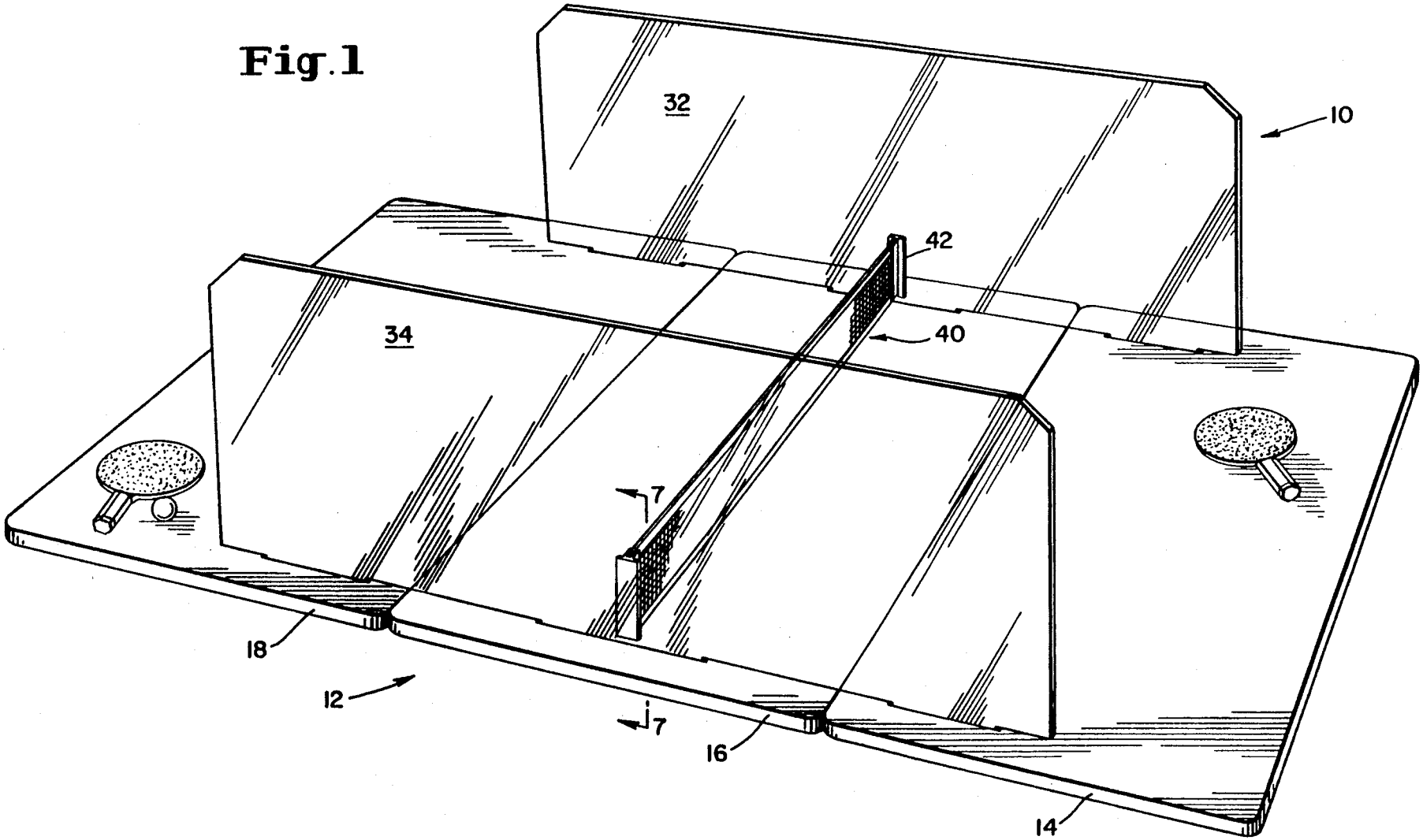
FIG. 1 is a perspective view illustrating the novel game apparatus of the invention as assembled.

The novel improved game apparatus 10 includes a base table section 12 formed by two flat end sheets 14 and 18 and a center sheet 16, each 3 feet wide by 2 feet long, the sheets when brought together as in FIG. 1 providing a flat, horizontal, rectangular playing surface 3 feet wide by 6 feet long. The sheets are advantageously constructed of lightweight thermoplastic material, e.g., high-impact polystyrene or low pressure structural foam, with each of the end sheets provided with a pair of laterally spaced longitudinally extending molded-in-place slots 19 and 20 extending parallel to each other adjacent the side edges of the sheets. Center sheet 16 has similar but longer slots 21 and 22. When assembled as in FIG. 1, the inner transverse edges 24 and 26 of end sheets 14 and 18, respectively, abut against the transverse edges 28 and 30 of center piece 16, and the longitudinal slots 19 and 21 respectively, and slots 20 and 22 respectively of the sheets are in longitudinal alignment.

Apparatus 10 also includes a pair of vertical side walls or wings 32 and 34 constructed of transparent material such as plexiglass approximately ⅛" thick by 18" high by 48" long with the side walls 32 and 34 respectively including a plurality of integral downwardly depending longitudinal elongated end tabs 36 and longer center tab 38 which fit snug in longitudinally aligned slots in end plates 14 and 18 and center plate 16. In this fashion side walls 32 and 34 are supported in a stable, upright position and lock the three sheets 14, 16, and 18 together in the assembled playing position of FIG. 1.

A net 40, approximately five inches high is positioned at the center of table section 16 and is suitably attached to side walls 32 and 34, for example, by Velcro connectors 42. Net 42 has an elastic fabric section 44 at each end which stretches and applies tension to the net assembled as in FIG. 1.

Figure 4:
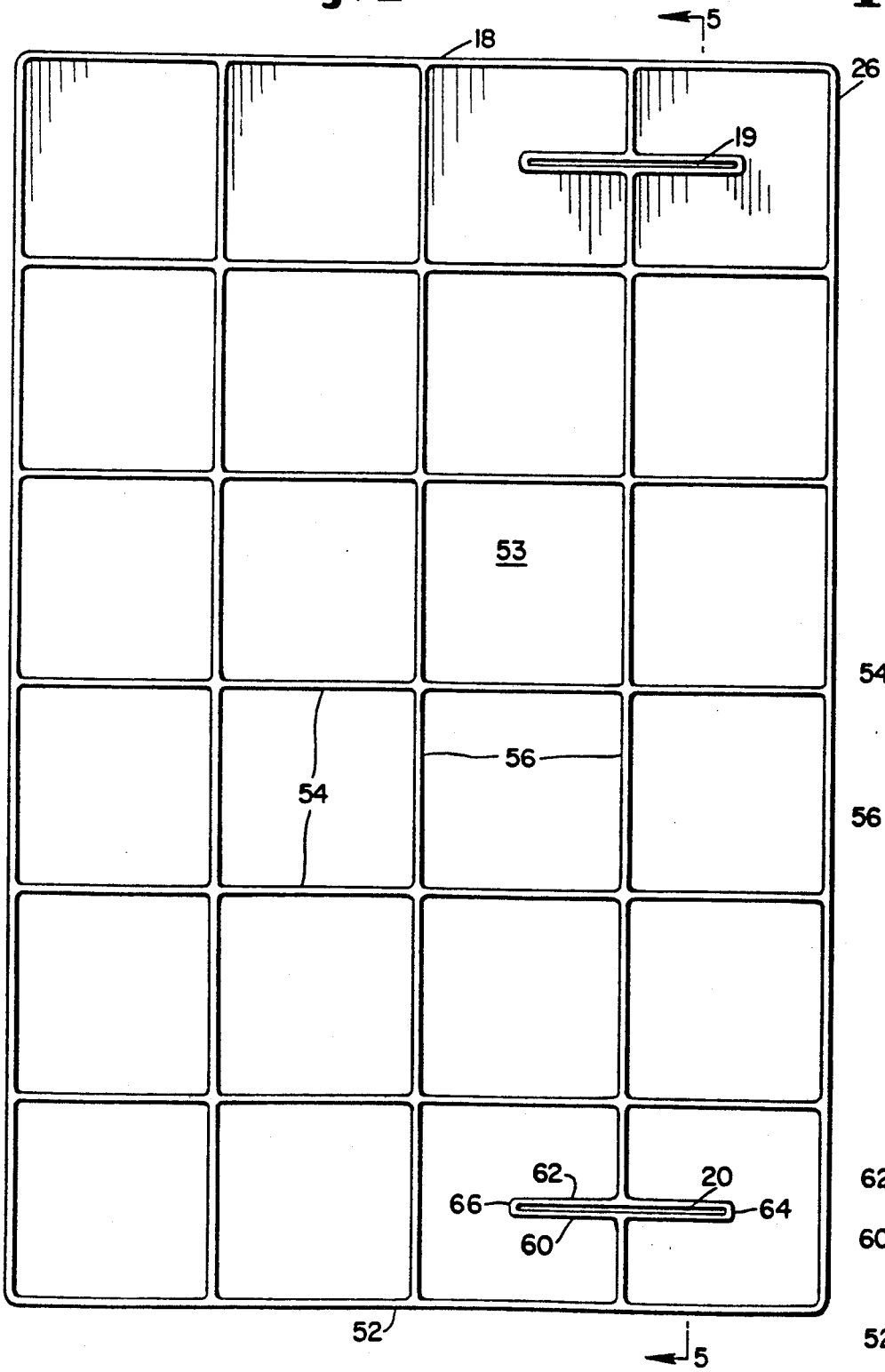
FIG. 4 is a bottom plan view of one of the table end sheets.
Figure 5:
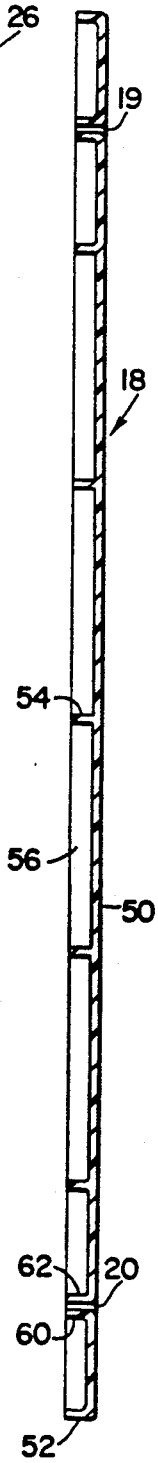
FIG. 5 is a fragmentary sectional view taken along line 5—5 of FIG. 4.
Figure 6:
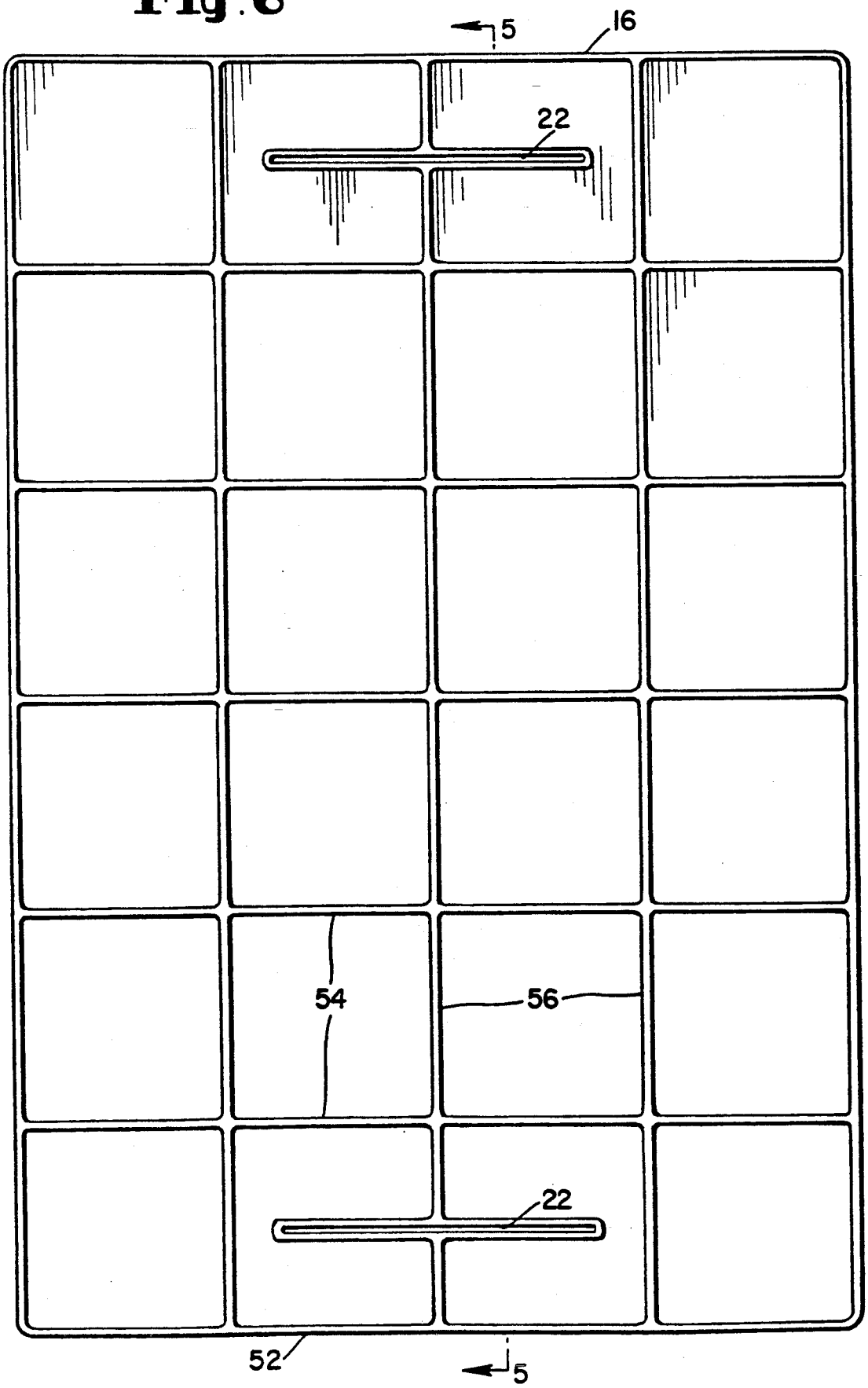
FIG. 6 is a bottom plan view of the table center sheet.
Figure 7:
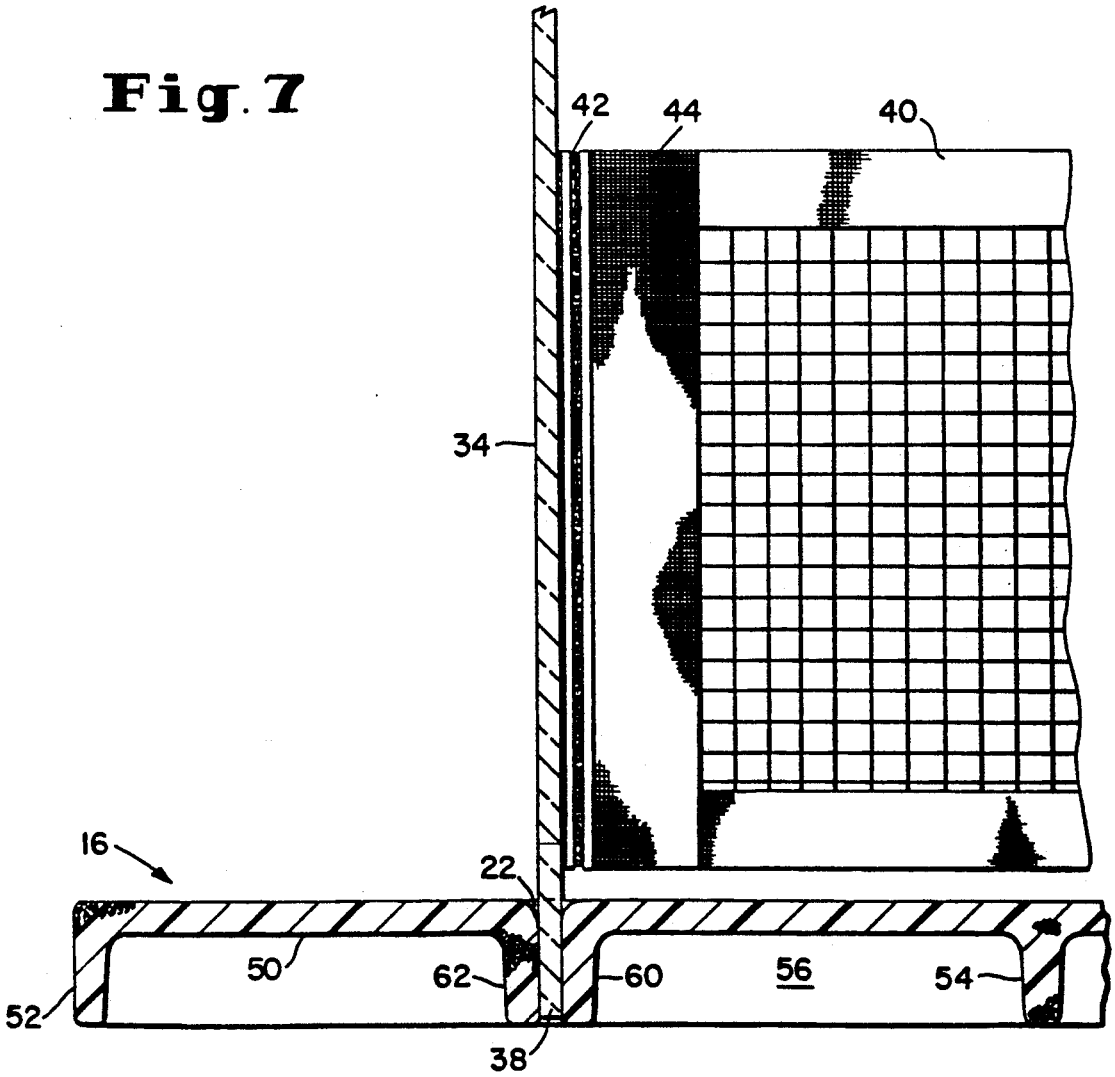
FIG. 7 is a fragmentary sectional view taken along line 7—7 of FIG. 1.

As mentioned hereinabove, the construction of the center sheet 16 and the two end sheets 14 and 18 is substantially identical, the only differences being that slots 21 and 22 are longer than slots 19 and 20 and that slots 19 and 20 are positioned longitudinally closer to the inner edges of plates 14 and 18 while slots 21 and 22 are centered longitudinally on plate 16. As illustrated in FIGS. 4, 5, and 6, each of the sheets is formed by a molded foam plate, which includes a flat top section 50 having a thickness of about 0.200 inches and a flange 52 extending downwardly from section 50 around the entire periphery thereof to define a chamber 53. The flange has a thickness of about 0.200 inches and a total depth of about ¾ inch from the top of section 50. Each of the plates also includes a stabilizing, reinforcing lattice type rib construction molded integrally onto the bottom of section 50 within chamber 53, the rib construction including a plurality of intersecting longitudinal and transverse ribs 54 and 56, respectively, integrally molded with the bottom of surface 50 and the inner surface of peripheral flange 52. The bottoms of flange 52 and ribs 54 and 56 lie in the same flat plane which is parallel to the top surface of section 50 so that the top of sheets 14, 16, and 18 provide a flat, horizontal playing surface when assembled as illustrated in FIG. 1.

In both the center sheet (FIG. 5) and the end sheets (FIG. 4) the slots 19 and 20 and slots 21 and 22 are of the same lateral spacing across the width of the sheets as shown in FIGS. 4 and 6. Each of the slots is formed by a pair of spaced longitudinally extending side walls 60 and 62 joined by end walls 64 and 66, all of which are integrally molded and depend downwardly from section 50 and terminate in the same bottom plane as flange 52 and ribs 54 and 56. As shown, slots 21 and 22 are longer than slots 19 and 20.

Figure 2:
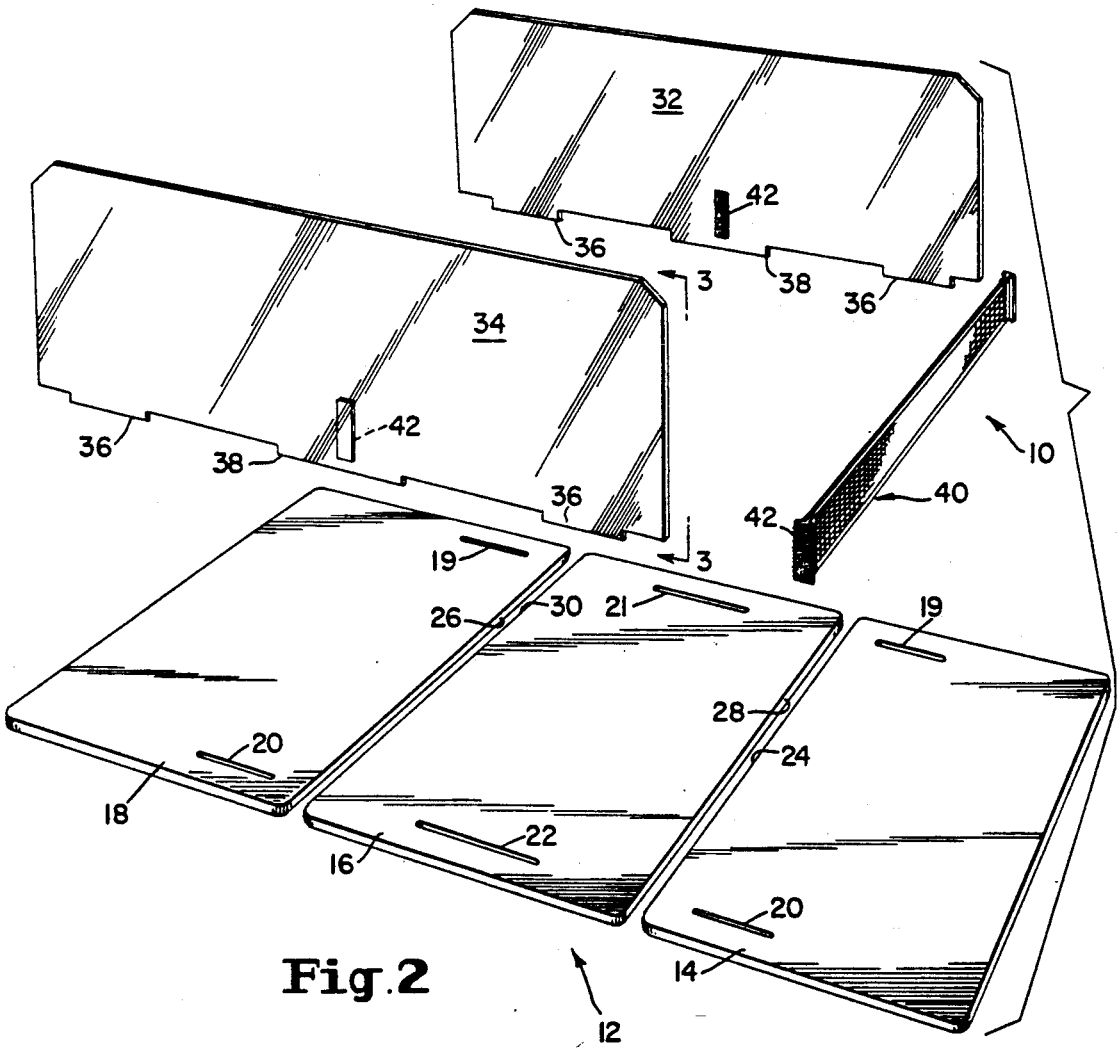
FIG. 2 is an exploded view of the novel game apparatus.
Figure 3:
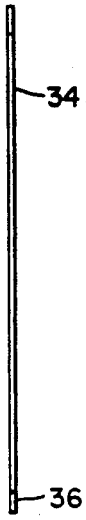
FIG. 3 is an end view of one of the side plates taken along line 3—3 of FIG. 2.

The other difference between center sheet 16 and end sheets 14 and 18 is the longitudinal location of the slots. As shown in FIG. 6, the slots 21 and 22 are centered longitudinally on center plate 16. As shown in FIGS. 2 and 4, the slots 19 and 20 are located closer to the inner edges 24 and 26 of sheets 14 and 18 respectively.

Thus, the longitudinal spacing of the slots in sheets 14, 16, and 18 will correspond to the longitudinal spacing between the tabs 36 and 38 of side walls 32 and 34 respectively when the apparatus is assembled together as illustrated in FIG. 1. In addition, the longer slots 21 and 22 and tabs 38 provide greater stability at the center of walls 32 and 34 where net 40 is attached.

Because the center plate 16 and end plates 14 and 18 are identical except for the slots, all the plates can be manufactured from the same mold assembly, and this substantially reduces production costs. During the molding operation it is necessary only to properly position suitable slot- forming inserts within the mold assembly to selectively manufacture either the center plate 16 or end plates 14 and 18.

Thus, it can be appreciated that the advantages afforded by the game apparatus described in my earlier U.S. Pat. No. 4,969,645 are retained within my improved design described hereinabove. However, it should also be apparent that significant manufacturing, packaging and storing advantages are provided by the improvements described herein. The table forming plates 14, 16, and 18 are very light in weight, but yet are sufficiently stable and strong to withstand continued use. Further, because the center plate and end plates are identical in size and construction except for the slots as noted above, only one mold assembly is required to form all the plates. Further, because I now form the 3 feet by 6 feet playing surface from three sheets, each 2 feet by 3 feet instead of two sheets 3 feet by 3 feet as in my earlier patent, the final packaging and storage space of the game in its disassembled condition is reduced. Also, because the slots 19, 20, 21 and 22 and tabs 36 and 38 are formed integrally in the table plates and side walls, the time required to manufacture the various components is reduced.

All of the described improvements substantially reduce the cost of manufacturing, packaging, and shipping the game apparatus and enhance commercial viability.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. Game apparatus for use with a ball and paddles comprising a plurality of flat sheet means assembled adjacent each other to define a substantially horizontal playing surface, each of said sheet means being a molded thermoplastic plate having a substantially flat upper surface and a lower surface and flange means extending around the periphery thereof and depending downwardly from said lower surface to define a hollow chamber therewith, a plurality of reinforcing ribs extending downwardly from said lower surface within said chamber, a pair of laterally spaced longitudinally extending slots being molded in each of said plates, said slots on one plate being longitudinally aligned with the slots on said other plates, first and second longitudinally extending spaced apart vertical wall means having downwardly depending tabs fitting within respective aligned slots to hold said sheet means together, and upstanding barrier means extending transversely across said playing surface between said first and second wall means.

2. The game apparatus of claim 1, wherein said reinforcing ribs are integrally molded with each said lower surface and said peripheral flange means.

3. The game apparatus of claim 2, wherein said ribs are formed in a lattice configuration.

4. The game apparatus of claim 2, wherein the bottom of said flange and said ribs lie in a common horizontal plane which is substantially parallel to said flat upper surface.

5. The game apparatus of claim 1, wherein the molded thermoplastic plates are substantially identical except for said slots on said plates.

6. The game apparatus of claim 1, wherein said flat sheet means includes a central plate and a pair of end plates located adjacent opposite ends of said central plate, said central plate and said end plates being substantially identical in construction except said slots on said plates.

7. The game apparatus of claim 6, wherein the slots on said central plate are located substantially midway between said opposite ends and said slots on said end plates are located closer to the edges of said end plates which are adjacent said central plate.

8. The game apparatus of claim 1, said upstanding barrier means comprising a net having its ends connected to said first and second wall means and including elastic means which stretch and apply tension to said net.

* * * * *